US008282205B2

(12) United States Patent
Choi et al.

(10) Patent No.: US 8,282,205 B2
(45) Date of Patent: Oct. 9, 2012

(54) KICKING UNIT AND IMAGE FORMING APPARATUS INCLUDING THE SAME

(75) Inventors: Jae-hoon Choi, Seoul (KR); Yong-sok Yang, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 709 days.

(21) Appl. No.: 12/041,850

(22) Filed: Mar. 4, 2008

(65) Prior Publication Data

US 2009/0015646 A1 Jan. 15, 2009

(30) Foreign Application Priority Data

Jul. 11, 2007 (KR) ..... 10-2007-0069501

(51) Int. Cl.
*B41J 2/01* (2006.01)

(52) U.S. Cl. ..... 347/104

(58) Field of Classification Search ..... 347/104
See application file for complete search history.

(56) References Cited

U.S. PATENT DOCUMENTS 5,841,450 A * 11/1998 Kawamura ..... 347/32
5,882,004 A * 3/1999 Padget ..... 271/119
6,478,295 B2 * 11/2002 Hwang et al. ..... 271/115

FOREIGN PATENT DOCUMENTS

JP 1-133830 5/1989

* cited by examiner

*Primary Examiner* — Uyen Chau N Le
*Assistant Examiner* — Hoang Tran
(74) *Attorney, Agent, or Firm* — Stanzione & Kim, LLP

(57) ABSTRACT

An image forming apparatus includes an image forming unit to move in a crossing direction to cross a printing medium feeding direction and to form an image on the printing medium, and a kicker to move together with a movement of the image forming unit and to feed the printing medium.

19 Claims, 11 Drawing Sheets

KICKING UNIT AND IMAGE FORMING APPARATUS INCLUDING THE SAME

CROSS-REFERENCE TO RELATED APPLICATIONS

This application claims priority under 35 U.S.C. §119(a) from Korean Patent Application No. 10-2007-0069501, filed on Jul. 11, 2007, in the Korean Intellectual Property Office, the disclosure of which is incorporated herein in its entirety by reference.

BACKGROUND OF THE INVENTION

1. Field of the Invention

Apparatuses and methods relating to a kicking unit and an image forming apparatus including the same, and more particularly, to a kicking unit to improve a driving configuration of a kicker, and an image forming apparatus including the same.

2. Description of the Related Art

An image forming apparatus includes an image forming unit to form an image on a printing medium. The image forming unit may be classified into an inkjet type, an electrophotographic type and a thermal transfer type according to an image forming type.

The image forming apparatus further includes a medium feeding unit which feeds the printing medium to the image forming unit, and discharges the printing medium from the image forming unit to the outside. A roller type medium feeding unit is generally used, which drives a pair of rollers facing each other to feed the printing medium.

Other than the roller type medium feeding unit, some image forming apparatuses employ a kicking type medium feeding unit which kicks a part of the printing medium to be fed.

Japanese Patent Publication No. H01-133830 discloses a kicker and a kicker driving motor which drives the kicker. As a plurality of links and crank arms are used to drive the kicker, a driving configuration of the kicker is complicated.

Also, as the kicker is driven by the driving motor, an additional control algorithm is required to control a position of the kicker and a rotation speed of the driving motor.

Further, if the driving motor drives other elements other than the kickers, the driving motor may be overloaded.

SUMMARY OF THE INVENTION

The present general inventive concept provides a kicking unit to simplify a driving configuration of a kicker, and an image forming apparatus including the same.

The present general inventive concept also provides a kicking unit to control a position of a kicker without an additional control algorithm, and an image forming apparatus including the same.

The present general inventive concept also provides a kicking unit to drive a kicker without a driving motor, and an image forming apparatus including the same.

Additional aspects and utilities of the present general inventive concept will be set forth in part in the description which follows and, in part, will be obvious from the description, or may be learned by practice of the present general inventive concept.

The foregoing and/or other aspects and utilities of the present general inventive concept are achieved by providing an image forming apparatus including an image forming unit to move in a crossing direction to cross a printing medium feeding direction and to form an image on the printing medium, and a kicker to move together with a movement of the image forming unit and to feed the printing medium.

The image forming unit may reciprocate between a first section and a second section, and the kicker moves together with the image forming unit in one of the first and second sections.

The first section may include a printing section in which the image forming unit forms an image on the printing medium.

The kicker may include a kicker main body to rotate clockwise and counterclockwise on a kicker axis substantially parallel with the crossing direction, and a kicker arm to extend from the kicker main body in a radial direction and to kick and transport the printing medium.

The kicker may be formed in a single body with a same material.

The image forming apparatus may include a kicker driver to convert a reciprocation of the image forming unit into a rotation of the kicker on the kicker axis.

The kicker driver may include a cam spirally formed on a circumference of the kicker main body in the direction of the kicker axis, and a kicker driving member engaged with the cam and to reciprocate with the image forming unit in the kicker driving section, and to rotate the kicker main body clockwise and counterclockwise.

The kicker main body may extend from the first section to the second section, and the cam is formed on a circumference of the kicker main body within the second section.

The image forming apparatus may include a guiding shaft to transverse the first and second sections to be substantially parallel with the crossing direction and to guide the reciprocation of the image forming unit, and the kicker driving member includes a plate which is provided in the guiding shaft, to contact the image forming unit and to reciprocate within the second section.

The cam may include a groove, and the plate includes an insertion projection to be inserted into the groove.

The kicker driver may include an elastic member to elastically bias the plate from the kicker driving section to the printing section.

The kicker driving member may be exposed to the outside and coupled with the image forming unit.

The cam may include a groove, and the kicker driving member includes a coupling projection to be inserted into the groove.

The image forming apparatus may include an image forming unit driver to reciprocate the image forming unit, and a controller to control the image forming unit driver to reciprocate the image forming unit in the first section while the printing medium is printed and in the second section after the printing medium is printed, respectively, and to discharge the printed printing medium to the outside.

The image forming apparatus may include a first medium feeding unit to feed the printing medium to the image forming unit at a normal feeding speed and an excessive feeding speed faster than the normal feeding speed in the printing medium feeding direction, wherein the controller controls the first medium feeding unit to feed the printed printing medium at the excessive feeding speed so that the printed printing medium is disposed in a position to be kicked by the kicker arm.

The foregoing and/or other aspects of the present general inventive concept are also achieved by providing a kicking unit of an image forming apparatus which includes a shuttle unit to reciprocate in a crossing direction to cross a printing medium feeding direction, the kicking unit including a kicker which includes a kicker main body to rotate clockwise and counterclockwise on a kicker axis in substantially parallel with the crossing direction, and a kicker arm to extend from the kicker main body in a radial direction and feed the printing medium in the printing medium feeding direction, and a kicker driver to convert a reciprocation of the shuttle unit into a rotation of the kicker.

The kicker may be formed in a single body with a same material.

The kicker driver may include a cam spirally formed on a circumference of the kicker main body in the direction of the kicker axis, and a kicker driving member engaged with the cam, and to reciprocate with the shuttle unit in at least a portion of a section to rotate the kicker main body clockwise and counterclockwise.

The shuttle unit may include an image forming unit to reciprocate between a printing section to print a printing medium and a kicker driving section outside the printing section.

The kicker main body may extend from the printing section to the kicker driving section, and the cam is formed on a circumference of the kicker main body within the kicker driving section.

The kicking unit may include a guiding shaft formed to traverse the printing section and the kicker driving section and to be substantially parallel with the crossing direction, and to guide the reciprocation of the image forming unit, wherein the kicker driving member includes a plate disposed in the guiding shaft, to contact the image forming unit and to reciprocate within the kicker driving section.

The cam may include a groove, and the plate includes an insertion projection to be inserted into the groove.

The kicker driver may include an elastic member to elastically bias the plate from the kicker driving section to the printing section.

The kicker driving member may be exposed to the outside and coupled with the shuttle unit.

The cam may include a groove, and the kicker driving member includes a coupling projection to be inserted into the groove.

The foregoing and/or other aspects and utilities of the general inventive concept may also be achieved by providing an image forming apparatus including a kicker to kick a printing medium, and an image forming unit to form an image on the printing medium in a printing section and to move the kicker in a kicker driver section.

The foregoing and/or other aspects and utilities of the general inventive concept may also be achieved by providing a method of moving a printing medium through an image forming apparatus having a kicking arm, the method including providing a kicker to kick a printing medium, and controlling an image forming unit to form an image on the printing medium in a printing section and to move the kicker in a kicker driver section.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
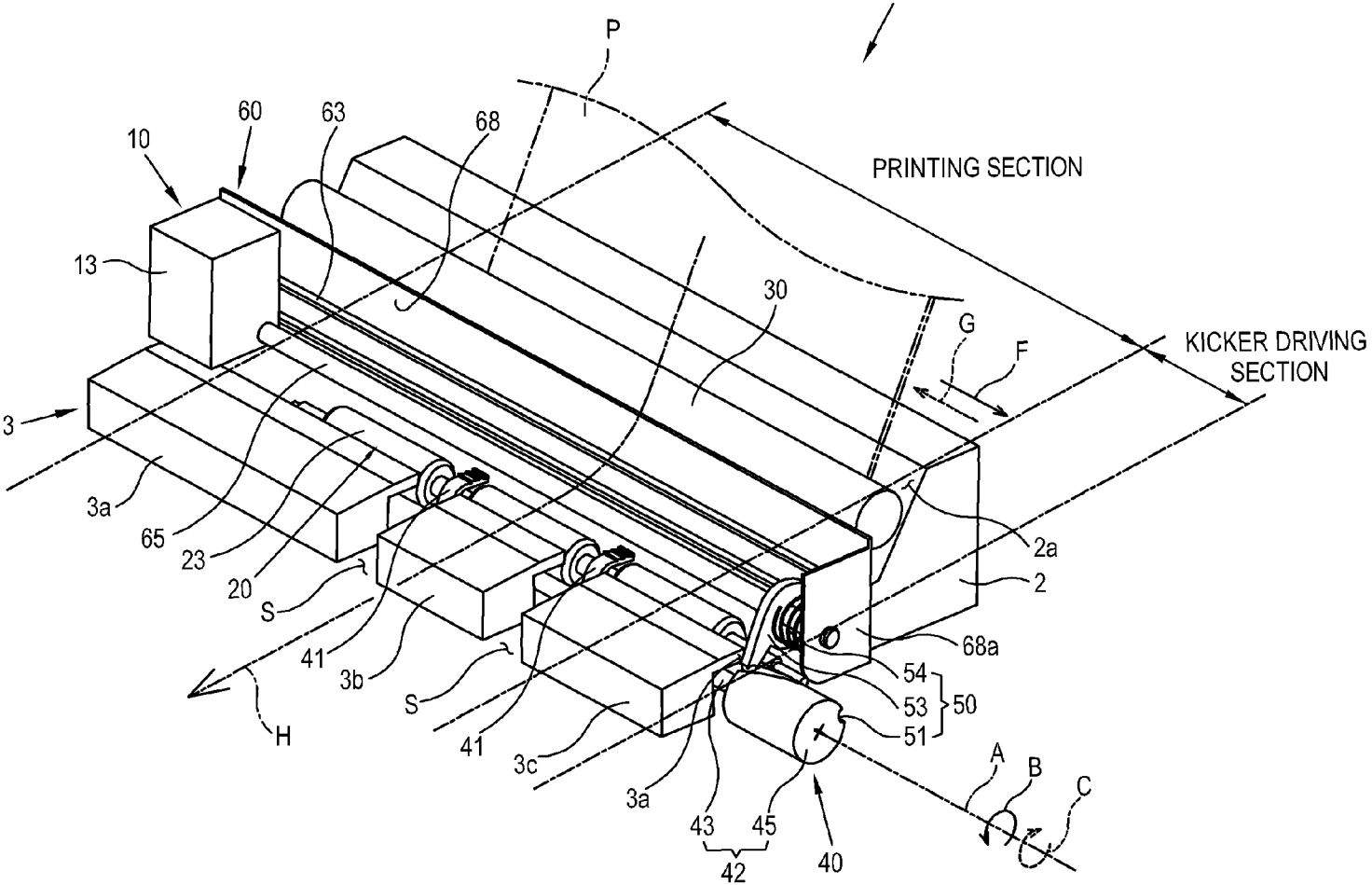
FIG. 1 is a schematic perspective view illustrating an image forming apparatus according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

As illustrated in FIG. 1, an image forming apparatus 1 according to an exemplary embodiment of the present general inventive concept includes an image forming unit 10, a kicker 40 and a kicker driver 50. The image forming apparatus 1 may include a kicking unit (not illustrated) including the kicker 40 and the kicker driver 50.

The image forming unit 10 may include an ink cartridge (not illustrated) which has a printing head, and a carriage 13. A plurality of nozzles is formed in the printing head to jet ink therethrough. An image is formed on a printing medium P by ink jetted through the nozzles.

The carriage 13 may support the ink cartridge and reciprocate along a guiding shaft 65. The guiding shaft 65 crosses a printing medium feeding direction H, and guides the carriage 13. The crossing direction may be substantially perpendicular to the printing medium feeding direction H, but not limited thereto.

The image forming unit 10 may reciprocate between a printing section and a kicker driving section outside the printing section, respectively. In the printing section, the image forming unit 10 reciprocates along the guiding shaft 65 and forms an image on the printing medium P. In the kicker driving section, the image forming unit 10 reciprocates in directions F and G, and applies a driving force to the kicker driver 50 (to be described later). The printing section and the kicker driving section may be called a first section and a second section, respectively. The image forming unit 10 progresses in the direction F to press a plate 53 (to be described later), and withdraws in the direction G to release the plate 53.

Figure 3:
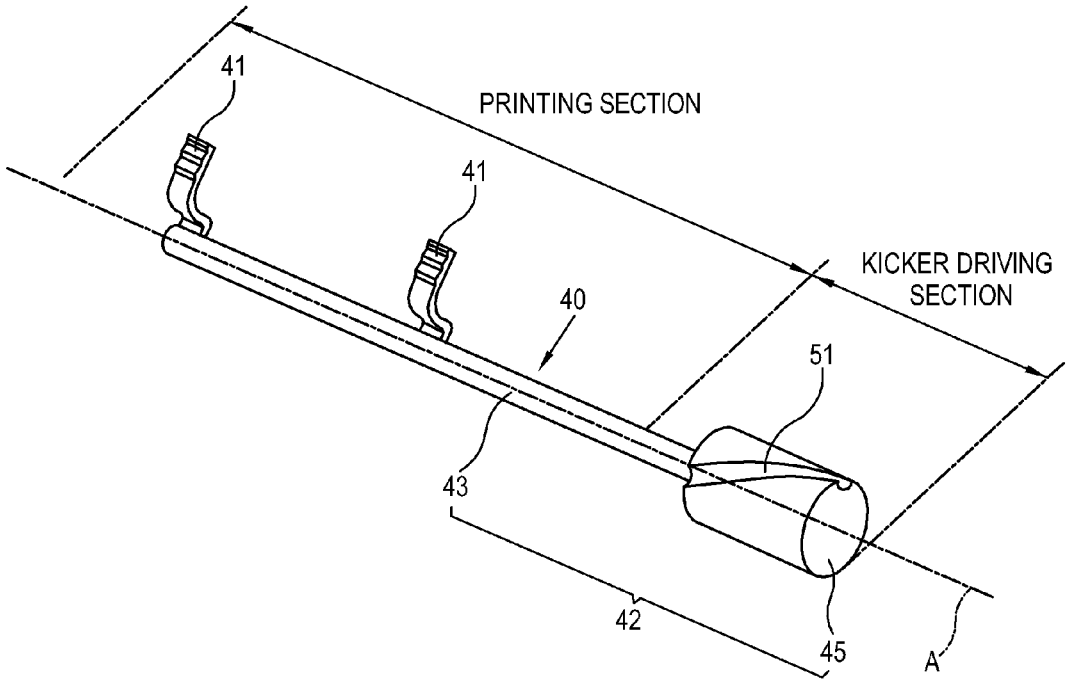
FIG. 3 is an enlarged perspective view illustrating the kicker of the image forming apparatus in FIG. 1.

As illustrated in FIGS. 1 and 3, the kicker 40 includes a kicker main body 42 which is formed along a kicker axis A in parallel with a transverse direction of the printing medium feeding direction H and rotates on the kicker axis A, and a kicker arm 41 to extend from the kicker main body 42 in a radial direction. In the present embodiment, the kicker 40 rotates when moving together with the image forming unit 10, to kick and feed the printing medium P. The kicker 40 may slide instead of rotating as long as the kicker 40 moves together with the image forming unit 10 and kicks and feeds the printing medium P. A shape of the kicker 40 is not limited to that illustrated in FIGS. 1 and 3. Alternatively, the shape of the kicker 40 may vary as long as the kicker 40 feeds the printing medium P.

In a standby position before the kicker arm 41 kicks the printing medium P, the kicker 40 may be disposed below a platen 3 supporting the printing medium P fed to the image forming unit 10, not to interrupt the printing medium P. The platen 3 may include a plurality of platens 3*a*, 3*b* and 3*c* which are spaced from each other at an interval S based on a rotating position of the kicker arm 41, not to interrupt the rotation of the kicker arm 41 disposed therebelow.

The kicker arm 41 is disposed in the printing section to kick the printing medium P fed from the image forming unit 10.

The kicker main body 42 may include a first kicker main body 43 to support the kicker arm 41, and a second kicker main body 45 which is connected with the first kicker main body 43 and to extend to the kicker driving section. The kicker arm 41 and the kicker main body 42 are formed in a single body with a same material, from an assembly point of view.

Here, the kicker 40 may feed or kick the printing medium by moving the printing medium according to a pushing force instead of a rotating friction force with which a conventional feeding roller feeds to a printing medium.

As illustrated in FIG. 3, axes of the first and second kicker main bodies 43 and 45 may be equivalent to the kicker axis A. As necessary, the axes of the first and second kicker main bodies 43 and 45 may be eccentric.

A cam 51 is formed along a circumference of the second kicker main body 45. Thus, the cam 51 has a limitation in reducing a radius of the second kicker main body 45. Meanwhile, the first kicker main body 43 only supports the kicker arm 41. Thus, a radius of the first kicker main body 43 may be reduced. The smaller the radius of the first kicker main body 43 is, the smaller the rotation inertia is. Accordingly, the radius of the first kicker main body 43 may be small to reduce a rotational moment to rotate the kicker 40.

Figure 6:
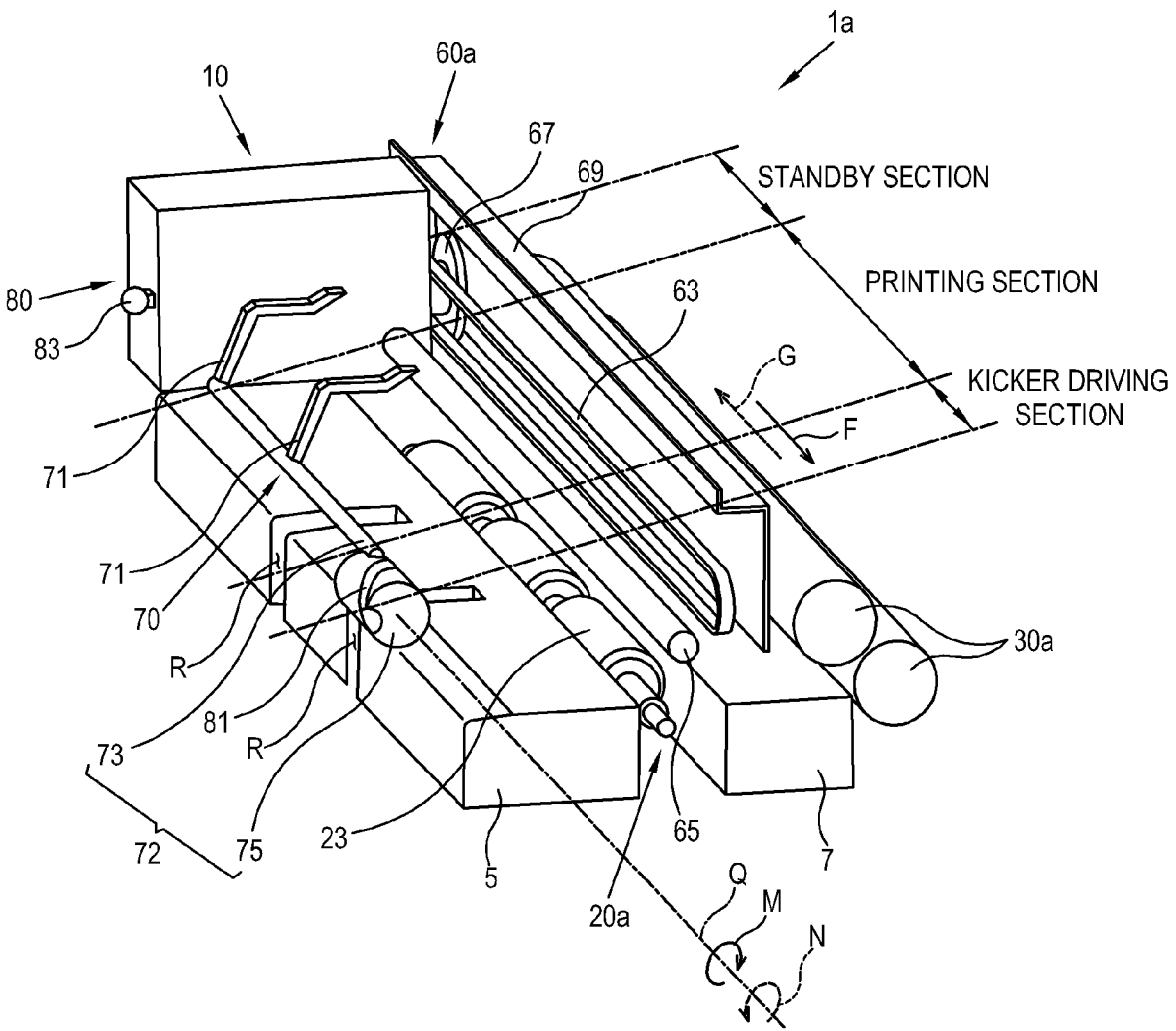
FIG. 6 is a schematic perspective view illustrating an image forming apparatus according to an exemplary embodiment of the present general inventive concept.
Figure 9:
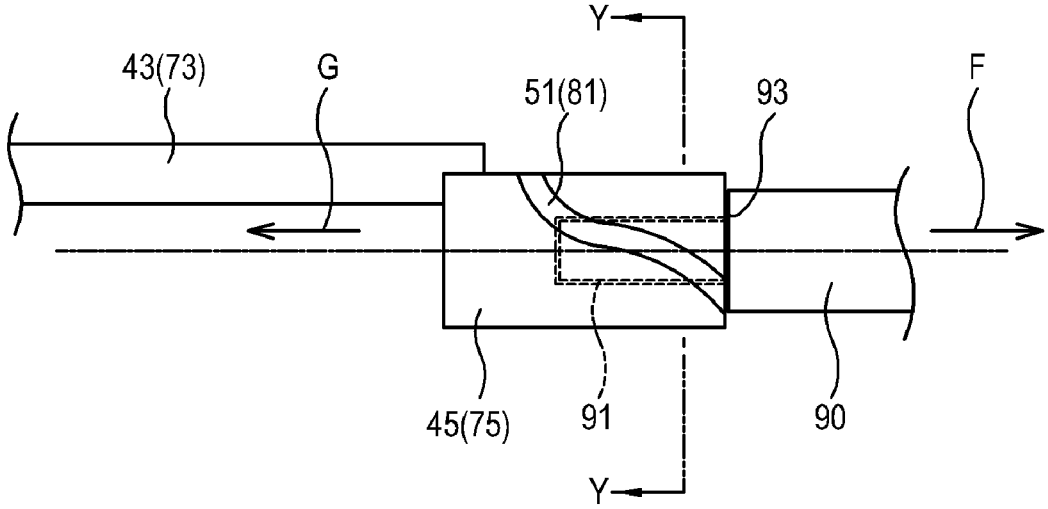
FIG. 9 is a schematic plan view illustrating a kicker supporter to rotatably support the kicker in FIG. 6.
Figure 10:
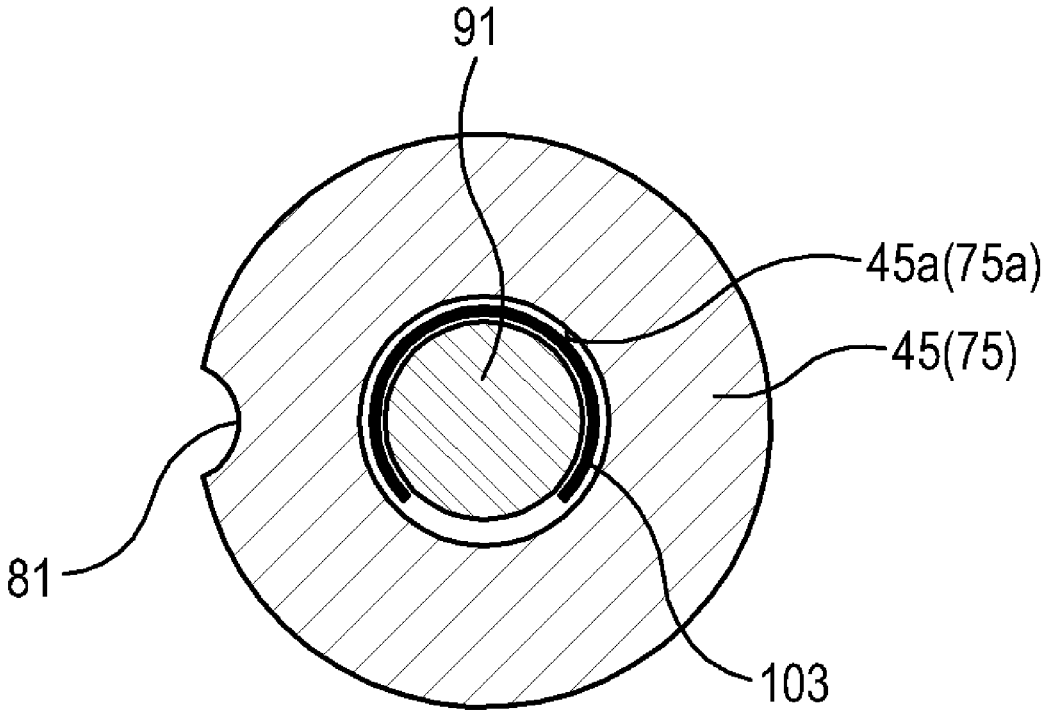
FIG. 10 is a sectional view illustrating the kicker supporter, taken along line Y-Y in FIG. 9.

The kicker main body 42 may be supported by a kicker supporter 90 (refer to FIGS. 9 and 10) to rotate clockwise and counterclockwise on the kicker axis A. Figures excluding FIGS. 9 and 10 do not illustrate the kicker supporter 90 for purposes of convenience. As illustrated in FIGS. 9 and 10, the kicker supporter 90 is disposed in the image forming apparatus 1 and includes a supporting shaft 91 to protrude toward the kicker axis A. The supporting shaft 91 is inserted into a shaft hole 45*a* which is formed in the direction of the kicker axis A of the second kicker main body 45. A reference numeral 103 in FIG. 10 refers to a torsion coil spring 103 which is employed in an image forming apparatus 1*a* according to an exemplary embodiment of the present general inventive concept as illustrated in FIG. 6. The torsion coil spring 103 will be described with reference to the embodiment as illustrated in FIG. 6.

Alternatively, the kicker supporter 90 may vary as long as the kicker supporter 90 supports the kicker 40 to rotate clockwise and counterclockwise along the kicker axis A.

Referring to FIG. 1, the kicker driver 50 converts a linear reciprocation of the image forming unit 10 along the guiding shaft 65 to the rotation of the kicker 40 clockwise and counterclockwise.

FIG. 1 illustrates that the kicker driver 50 includes the cam 51 spirally formed on a circumference of the second kicker main body 45 along the kicker axis A, the plate 53 which is engaged with the cam 51 and reciprocates in the kicker driving section, and an elastic member 54 to elastically bias the plate 53 toward the printing section. The plate 53 may be called a kicker driving member.

The cam 51 may be a groove or a protrusion.

As illustrated therein, the plate 53 can be disposed on the guiding shaft 65 to guide the image forming unit 10 to simplify the configuration. As necessary, an additional plate guiding shaft (not illustrated) may be provided in parallel with the guiding shaft 65 to guide the plate 53.

Figure 2:
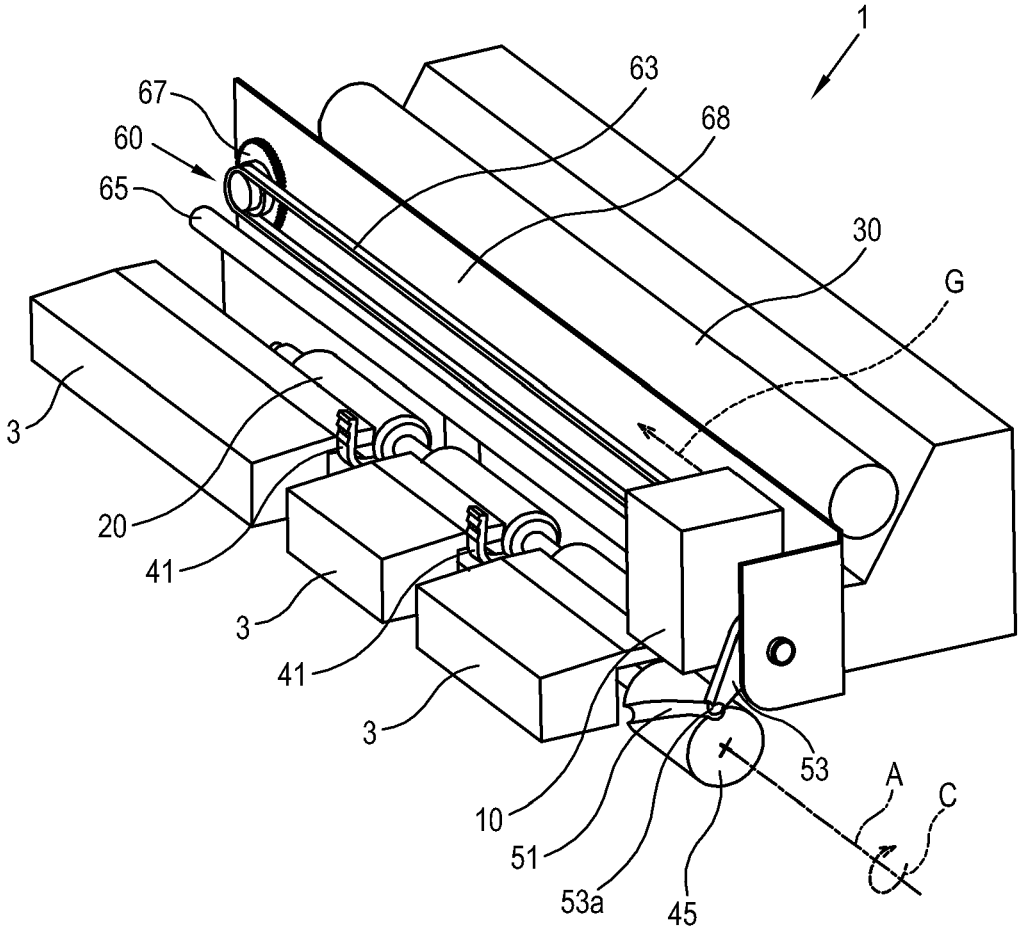
FIG. 2 is a schematic perspective view illustrating a rotating kicker of the image forming apparatus in FIG. 1.

As illustrated in FIG. 2, the plate 53 may include a contact projection 53*a* which is engaged with the cam 51 having a groove shape. If the cam 51 protrudes instead of being recessed like a groove, the contact projection 53*a* may be changed to a groove shape corresponding to the cam 51. That is, the cam 51 and the contact projection 53*a* correspond to each other to be engaged with each other.

As the image forming unit 10 progresses in the direction F within the kicker driving section and presses the plate 53, the plate 53 progresses in the same direction F as the image forming unit 10. Then, the contact projection 53*a* of the plate 53 is engaged with the cam 51 to progress in the direction F. The second kicker main body 45 having the cam 51 rotates in a direction B. As the second kicker main body 45 rotates in the direction B, the kicker arm 41 also rotates in the direction B from a position in FIG. 1 to a position in FIG. 2.

If the image forming unit 10 withdraws in the direction G and releases the plate 53, the plate 53 withdraws in the same direction G by the elastic force of the elastic member 54 (FIG. 1) and returns to the original position before contacting the image forming unit 10. As the contact projection 53*a* withdraws in the direction G, the cam 51 being engaged with the contact projection 53*a* rotates in a direction C. Then, the second kicker main body 45 also rotates in the direction C, and the kicker arm 41 rotates from the position illustrated in FIG. 2 to the position illustrated in FIG. 1.

Referring to FIGS. 1 and 2, the elastic member 54 may be disposed between a frame 68 to support a pulley 67 (refer to FIG. 2) of an image forming unit driver 60 (to be described later), and the plate 53. The position of the elastic member 54 may vary as long as the elastic member 54 performs the foregoing functions. As necessary, a stopper (not illustrated) may be provided to prevent the plate 53 elastically biased by the elastic member 54, from moving to the printing section.

The image forming apparatus 1 according to the embodiment illustrated in FIG. 1 may further include a pickup roller 30, a first medium feeding unit 20, and the image forming unit driver 60 to reciprocate the image forming unit 10.

The pickup roller 30 is provided on a storage surface 2*a* of a storage unit 2 to store the printing medium P, and picks up the printing medium P from the storage surface 2*a* to be fed to the first medium feeding unit 20.

The first medium feeding unit 20 feeds the printing medium P to the image forming unit 10, in the printing medium feeding direction H. The first medium feeding unit 20 may include a plurality of feed rollers 23 which are spaced from each other along a roller shaft in parallel with the guiding shaft 65, and an idle roller (not illustrated) which is engaged with the feed rollers 23 and rotates. The first medium feeding unit 20 may further include a feed roller driver (not illustrated) to drive the feed rollers 23.

As illustrated in FIGS. 1 and 2, the image forming unit driver 60 includes the guiding shaft 65, a belt 63 which is connected with the carriage 13 of the image forming unit 10, a plurality of pulleys 67 to circulate the belt 63, and the frame 68 to support the pulleys 67. The image forming unit driver 60 further includes a driving motor (not illustrated) to rotatably drive one of the plurality of pulleys 67.

The image forming apparatus 1 according to the embodiment illustrated in FIG. 1 may further include a controller (not illustrated) to control the pickup roller 30, the first medium feeding unit 20 and the image forming unit driver 60.

Hereinafter, the operation of the image forming apparatus 1 having the foregoing elements will be described with reference to FIGS. 1, 4 and 5.

The pickup roller 30 picks up the printing medium P from the storage unit 2 to be fed to the first medium feeding unit 20. The first medium feeding unit 20 feeds the picked printing medium P to the image forming unit 10 in the printing medium feeding direction H.

The image forming unit 10 reciprocates along the guiding shaft 65 within the printing section, and forms an ink image on the printing medium P fed by the first medium feeding unit 20. The method of forming the ink image by movement of the image forming unit 10 is known, and the detailed description thereof will be avoided here.

If the printing medium P is completely printed by the image forming unit 10, the controller controls the image forming unit driver 60 to move the image forming unit 10 in the directions F and G, i.e. to reciprocate within the kicker driving section. Then, the plate 53 progresses in the direction F and rotates the kicker 40 in the direction B.

Figure 4:
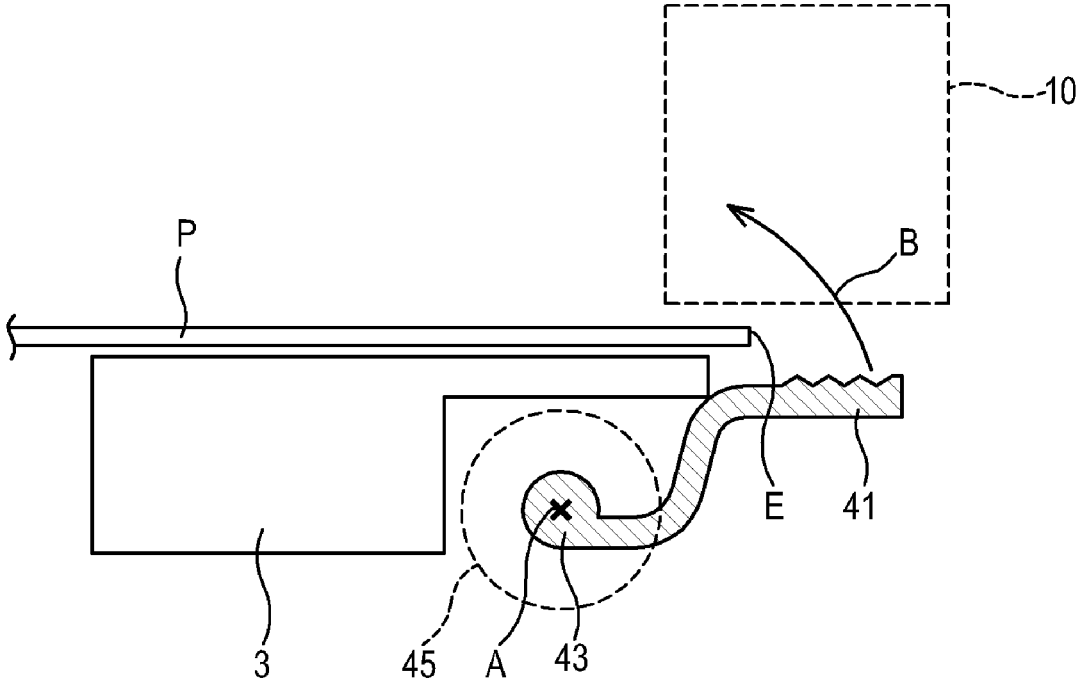
FIGS. 4 and 5 illustrate an operation illustrating the kicker of the image forming apparatus in FIG. 1.
Figure 5:
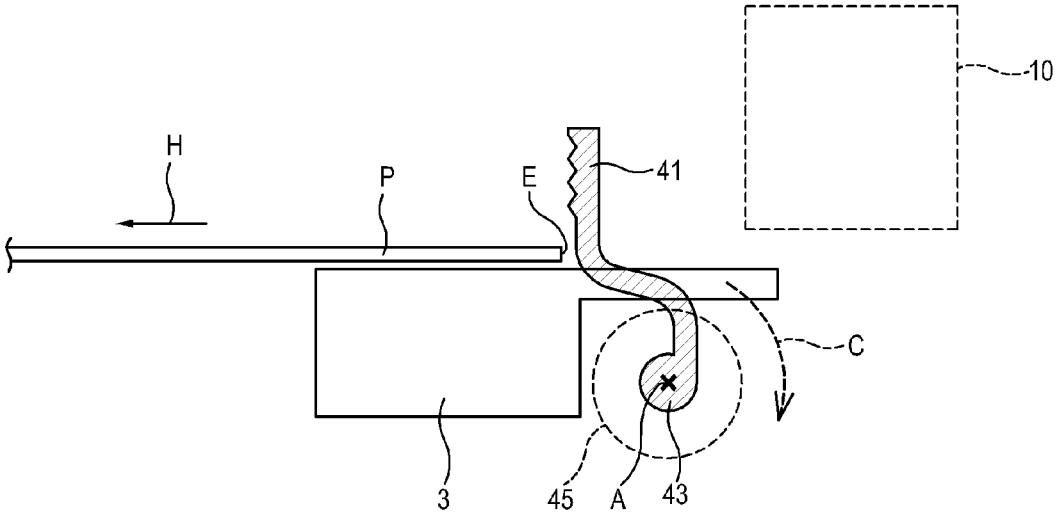

As illustrated in FIGS. 4 and 5, the kicker arm 41 disposed below the platen 3 rotates in the direction B on the kicker axis A, and kicks a rear end E of the printed printing medium P to be fed in the printing medium feeding direction H. A stacking plate (not illustrated) may be provided behind the platen 3 in the printing medium feeding direction H to stack the printed printing medium P thereon. Then, a user may easily pick up the printed printing medium P fed by the kicker arm 41.

As the image forming unit 10 withdraws in the direction G, the plate 53 also withdraws by the elastic member 54. As illustrated in FIG. 5, the kicker arm 41 moves from the kicking position (refer to FIG. 4) in the direction C and returns to the original position before kicking the printing medium P, by the cam 51 (FIG. 2) and the contact projection 53*a* (FIG. 2) being engaged with each other.

As described above, referring to FIG. 1, the cam 51 is formed in the kicker 40, and the plate 53 contacts the image forming unit 10 and linearly reciprocates, thereby simplifying the driving configuration of the kicker 40.

Also, if the plate 53 is released from the image forming unit 10, the position of the kicker arm 41 is controlled by the contact projection 53*a* and the cam 51 without an additional control algorithm.

Further, a linear reciprocation of the image forming unit 10 is converted into the rotation of the kicker without an additional driving motor, thereby reducing production costs.

Figure 7:
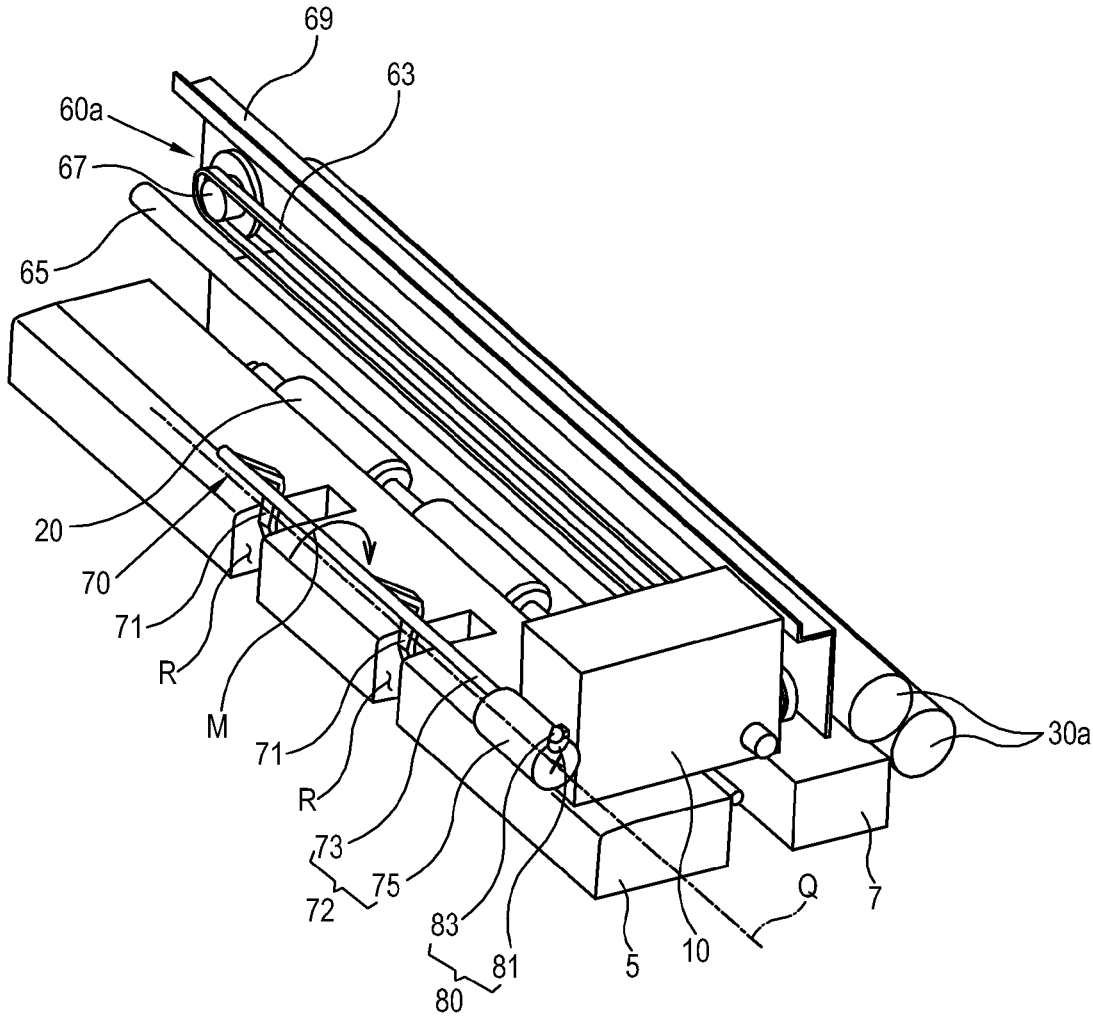
FIG. 7 is a schematic perspective view illustrating a rotating kicker of the image forming apparatus in FIG. 6.

As illustrated in FIGS. 6 and 7, an image forming apparatus 1*a* according to another exemplary embodiment of the present general inventive concept includes an image forming unit 10, a kicker 70 and a kicker driver 80 like those according to the embodiment as illustrated in FIG. 1.

As illustrated in FIG. 6, the image forming unit 10 may move to a standby section opposite to a kicker driving section, leaving a printing section therebetween. If the image forming unit 10 includes nozzles, the nozzles may be cleaned in the standby section. The image forming unit 10 may stay in the standby section before a printing operation.

Compared to the kicker 40 according to the embodiment illustrated in FIG. 1, a kicker axis Q of the kicker 70 according to the present embodiment is provided above a platen 5. As illustrated in FIG. 4, the kicker axis A of the kicker 40 according to the embodiment as illustrated in FIG. 1 is provided below the platen 3, and the kicker arm 41 rotates upwards to kick the printing medium P.

Meanwhile, the kicker axis Q of the kicker 70 according to the present embodiment is provided above the plate 5. Thus, a kicker arm 71 rotates downwards to kick a printing medium.

As illustrated in FIG. 6, the kicker 70 includes a kicker main body 72 to rotate clockwise and counterclockwise on the kicker axis Q, and the kicker arm 71 to extend from the kicker main body 72 in a radial direction and to kick the printing medium fed by the image forming unit 10.

The kicker main body 72 includes a first kicker main body 73 to support the kicker arm 71, and a second kicker main body 75 which is connected with the first kicker main body 73 and forms a cam 81 on a circumference thereof. As illustrated therein, axes of the first and second kicker main bodies 73 and 75 may be eccentric. That is, the axis of the second kicker main body 75 corresponds to the kicker axis Q and the axis of the first kicker main body 73 is spaced from the kicker axis Q. The first kicker main body 72 can be eccentric to the kicker axis Q to shorten the length of the kicker arm 71.

The kicker arm 71 is disposed within the printing section to kick and feed the printing medium while the second kicker main body 75 is disposed within the kicker driving section.

The kicker arm 71 and the kicker main body 72 of the kicker 70 are formed in a single body with a same material, from an assembly point of view.

As illustrated in FIGS. 6, 9 and 10, the kicker 70 is supported by the kicker supporter 90 to rotate on the kicker axis Q. An insertion hole 75*a* is formed in the second kicker main body 75 of the kicker 70 along the kicker axis Q. As a supporting shaft 91 of the kicker supporter 90 is inserted into the insertion hole 75*a*, the kicker 70 is rotatably supported by the kicker supporter 90. If a kicker driving member 83 which will be described later contacts a cam 81 formed in the second kicker main body 75, the linearly-moving kicker driving member 83 is engaged with the cam 81 to linearly move the kicker 70 along the kicker axis Q.

To improve conversion efficiency in converting the linear movement of the kicker driving member 83 (precisely the image forming unit 10) into the rotation of the kicker 70, the linear movement of the kicker 70 can be blocked. Thus, a step 93 is formed in a radial direction of the supporting shaft 91 to prevent the linear movement of the second kicker main body 75 in a direction F. The step 93 is also formed in a second end of the second kicker main body 75 to prevent the linear movement of the kicker 70 in a direction G. The kicker 70 rotates instead of linearly moving, thereby securing an optimal conversion efficiency.

A torsion coil spring 103 may be disposed between the supporting shaft 91 and the second kicker main body 75 as illustrated in FIG. 10 so that the kicker arm 71 is stopped in a position as illustrated in FIG. 6. The torsion coil spring 103 applies a rotational moment in a direction N in FIG. 6 to prevent the kicker arm 71 from rotating in a direction M in FIG. 6 by self-weight. A spring constant of the torsion coil spring 103 may be determined properly not to disturb the kicker arm 71 which is rotated by a kicker driver 80 (to be described later).

Like in the embodiment illustrated in FIG. 1, the kicker driver 80 drives the kicker 70 by converting the linear reciprocation of the image forming unit 10 along the guiding shaft 65 into the rotation of the kicker 70.

Referring to FIG. 6, the kicker driver 80 includes the cam 81 which is spirally formed on the circumference of the second kicker main body 75 in the direction of the kicker axis Q, and the kicker driving member 83 which is exposed to the outside and coupled with the image forming unit 10 to move together with the image forming unit 10.

As the image forming unit 10 progresses in the direction F within the kicker driving section, the kicker driving member 83 is engaged with the cam 81 and rotates the kicker main body 72 in the direction M. As illustrated in FIG. 7, the kicker arm 71 also rotates in the direction M to kick the printing medium.

If the image forming unit 10 withdraws in the direction G from the direction F, the kicker driving member 83 rotates the kicker main body 72 in the direction N to restore the kicker arm 71 to an original position before kicking the printing medium as illustrated in FIG. 6.

As illustrated in FIG. 6, the kicker driving member 83 may include a coupling projection which is shaped like a sphere and coupled with the image forming unit 10. The shape of the coupling projection is not limited to the sphere, and may vary as long as the coupling projection is engaged with the cam 81 and rotates the second kicker main body 85 having the cam 81.

The cam 81 may include one of a groove and a rib. The shape of the kicker driving member 83 corresponds to that of the cam 81 to be engaged therewith.

The image forming apparatus 1*a* according to the embodiment illustrated in FIG. 6 may further include a plurality of pickup rollers 30*a*, the platens 5 and 7 to support the printing medium fed by the image forming unit 10, and an image forming unit driver 60*a* to drive a first medium feeding unit 20*a* and the image forming unit 10.

The first medium feeding unit 20*a* is disposed between the platens 5 and 7. An interruption avoiding space R is formed in the platen 5 not to interrupt the rotating kicker arm 71.

The first medium feeding unit 20*a* feeds the printing medium P picked by the pickup rollers 30*a* to the image forming unit 10. The first medium feeding unit 20*a* may include a feed roller 23, an idle roller 25, and a feed roller driving motor (not illustrated) to drive the feed roller 23. Unlike the embodiment as illustrated in FIG. 1, the first medium feeding unit 20*a* according to the present embodiment may feed the printing medium P to the image forming unit 10 at one of a normal feeding speed and an excessive feeding speed faster than the normal feeding speed as a controller (not illustrated) controls the rotation speed of the feed roller driving motor.

Figure 8:
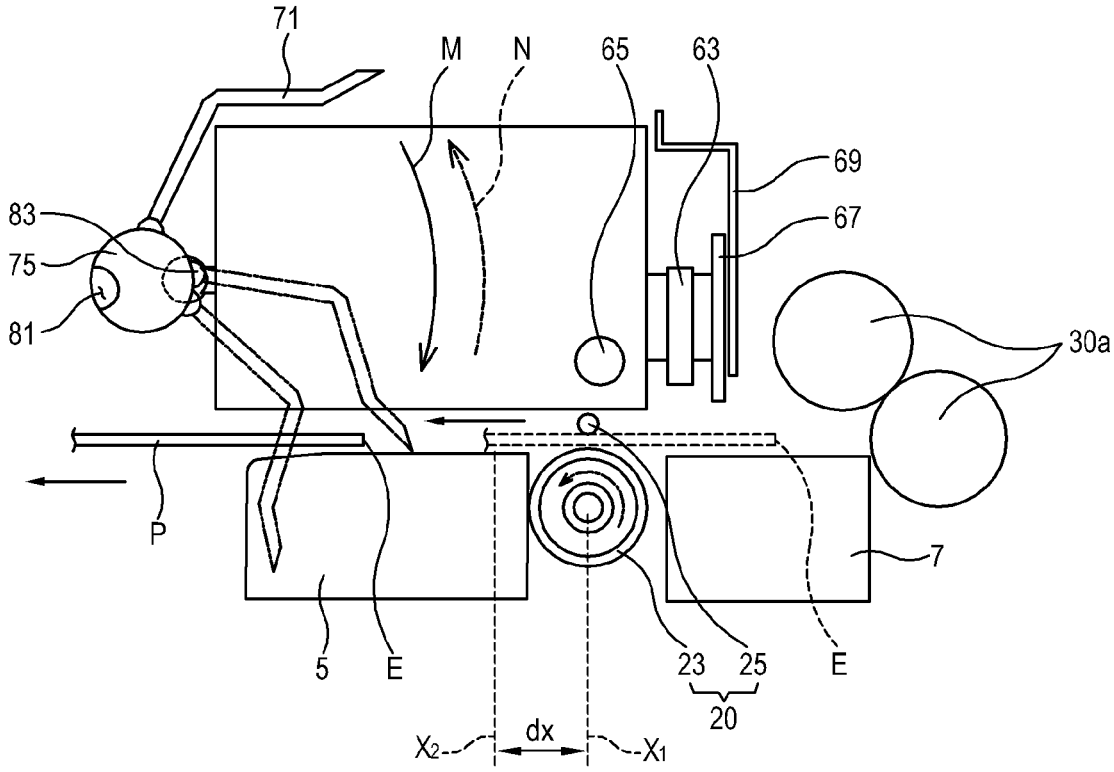
FIG. 8 is a schematic lateral view to illustrate an operation of the kicker of the image forming apparatus in FIG. 6.

Referring to FIGS. 6-8, the first medium feeding unit 20*a* feeds the printing medium P at the normal feeding speed while the image forming unit 10 prints the printing medium P in the printing section. If the printing medium P is completely printed, the first medium feeding unit 20*a* feeds the printed printing medium P at the excessive feeding speed to be kicked by the kicker arm 71.

The image forming unit driver 60*a* according to the present embodiment is equivalent to that according to the embodiment as illustrated in FIG. 1, except that a frame 69 has a different shape from the frame 68 according to the embodiment as illustrated in FIG. 1. Thus, the detailed description thereof will be avoided here.

The image forming apparatus 1*a* according to the present embodiment may further include the controller to control the image forming unit driver 60*a* and the first medium feeding unit 20*a*.

Hereinafter, the process of kicking and feeding the printing medium P by the kicker arm 71 will be described.

If the printing medium P is printed, the controller controls the first medium feeding unit 20*a* to feed the printed printing medium P at the excessive feeding speed. The printed printing medium P is fed to a kickable position X2 so that a rear end E of the printed printing medium P is kicked by the kicker arm 71.

Referring to FIGS. 6-8, the excessive feeding speed may be determined properly in consideration of a distance dX between the feed roller position X1 and the kickable position X2, to move the rear end E of the printing medium P as far as the distance dX by inertial force in the printing medium feeding direction, without an additional feeding force.

The controller controls the image forming unit driver 60*a* to move the image forming unit 10 to the kicker driving section and progress in the direction F within the kicker driving section. The cam 81 is engaged with the kicker driving member 83, and the kicker arm 71 rotates in the direction M and kicks the rear end E of the printing medium at the kickable position X2 and transports the printing medium in the printing medium feeding direction.

The controller then controls the image forming unit driver 60*a* to withdraw the image forming unit 10 in the direction G. Then, the kicker arm 71 rotates in the direction N and returns to the original position before kicking the printing medium P.

The image forming unit 10 which reciprocates linearly is provided as a driving source to drive the kickers 40 and 70, but not limited thereto. Alternatively, other members which reciprocate linearly may be provided as the driving source.

If the members which reciprocate linearly are not provided, an additional member may be provided to drive the kickers. Accordingly, the additional member may be driven by a driving motor in the image forming apparatus, e.g. a feed roller driving motor, instead of by an additional driving motor.

Figure 11:
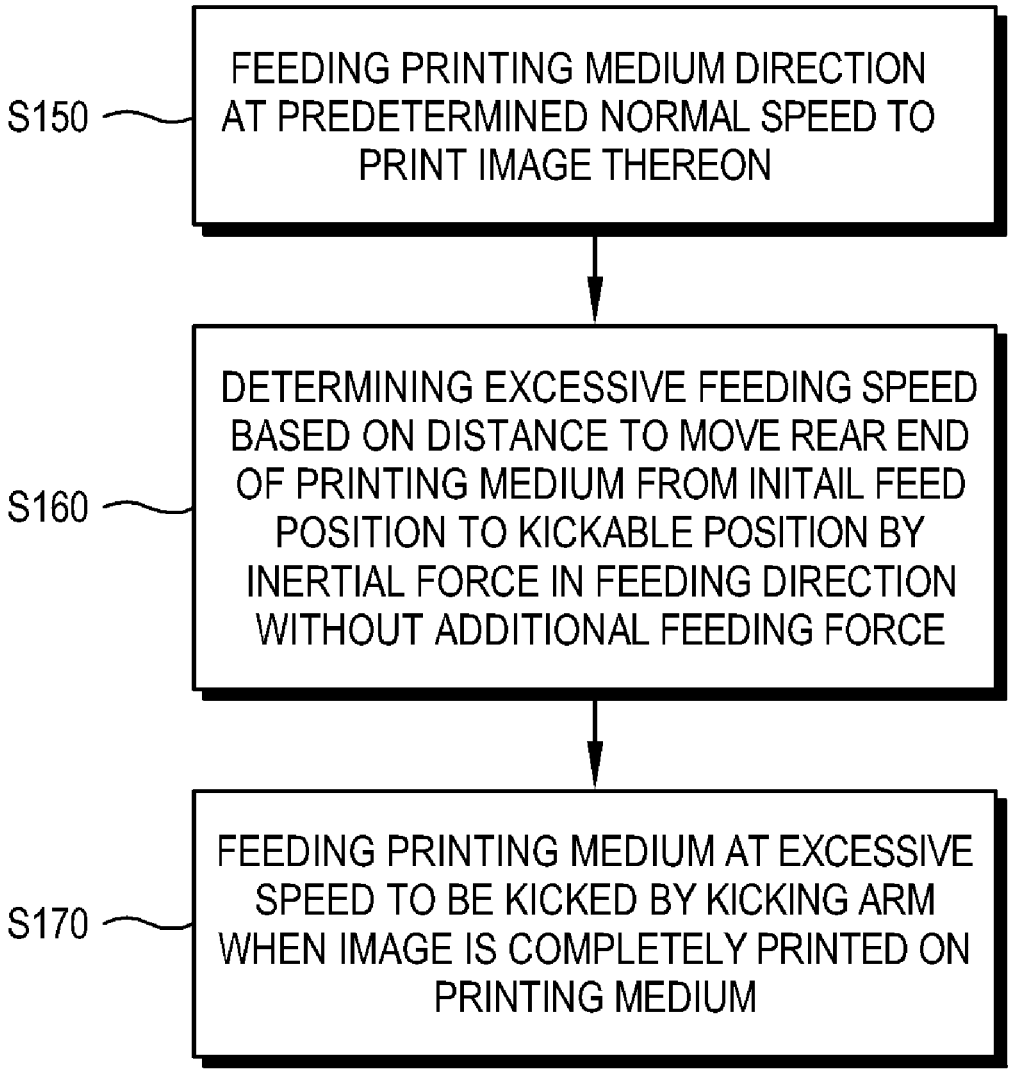
FIG. 11 is a flowchart illustrating a method of moving a printing medium through an image forming apparatus according to an exemplary embodiment of the present general inventive concept.

FIG. 11 is a flowchart illustrating a method of moving a printing medium through an image forming apparatus having a kicking arm according to an exemplary embodiment of the present general inventive concept. Referring to FIG. 11, in operation S150, a printing medium is fed in a feeding direction at a predetermined normal speed to print an image thereon. In operation S160, an excessive feeding speed is determined based on a distance to move a rear end of the printing medium from an initial feed position to a kickable position by an inertial force in the feeding direction without an additional feeding force. In S170, the printing medium is fed at the excessive speed to be kicked by the kicking arm when the image is completely printed on the printing medium.

The present general inventive concept can also be embodied as computer-readable codes on a computer-readable medium. The computer-readable medium can include a computer-readable recording medium and a computer-readable transmission medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

The kicking unit and the image forming apparatus including the same according to the present general inventive concept provides the following effects.

First, a cam is formed in a kicker and kicker driving members which reciprocate linearly together with an image forming unit are employed, thereby simplifying a driving configuration of the kicker.

Second, kicker arms return to an original position and the position of the kicker arms is controlled without an additional control algorithm.

Third, even if an additional driving motor is not used, a linear reciprocation of an image forming unit is converted into a rotation of kickers, thereby reducing production costs.

Although various embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

an image forming unit to move between a printing section for forming an image on a printing medium and a kicker driving section outside the printing section; and a kicker to move the printing medium, the kicker comprising:

a kicker driver to convert the movement of the image forming unit in the kicker driving section into a rotation of the kicker on a kicker axis, the kicker driver comprising:

a cam spirally formed on a circumference of a main body of the kicker in the direction of the kicker axis, and a kicker driving member engaged with the cam to move with the image forming unit in the kicker driving section, and to rotate the kicker main body clockwise and counterclockwise, wherein the movement of the image forming unit in the kicker driving section applies a driving force to the kicker.

2. The image forming apparatus according to claim 1, wherein the kicker axis is substantially parallel with the movement of the image forming unit; and the kicker comprises a kicker arm to extend from the kicker main body in a radial direction and to kick and transport the printing medium.

3. The image forming apparatus according to claim 2, wherein the kicker main body and the kicker arm are formed in a single body with a same material.

4. The image forming apparatus according to claim 1, wherein the kicker main body extends from the printer section to the kicker driving section, and the cam is formed on a circumference of the kicker main body within the kicker driving section.

5. The image forming apparatus according to claim 1, further comprising:

a guiding shaft formed to transverse the printing section and kicking driver section and to be substantially parallel with the movement of the image forming unit to guide the movement of the image forming unit, wherein the kicker driving member comprises a plate disposed adjacent to the guiding shaft to contact the image forming unit and to move within the kicker driving section.

6. The image forming apparatus according to claim 5, wherein the cam comprises:

a groove, and the plate comprises at least one of an insertion projection and a coupling projection to be inserted into the groove.

7. The image forming apparatus according to claim 5, wherein the kicker driver further comprises:

an elastic member to elastically bias the plate from the kicker driving section to the printing section.

8. The image forming apparatus according to claim 1, wherein the kicker driving member is exposed to the outside and contacts the image forming unit.

9. The image forming apparatus according to claim 1, further comprising:

an image forming unit driver to move the image forming unit, and a controller to control the image forming unit driver to move the image forming unit in the printing section while the printing medium is printed and in the kicker driving section after the printing medium is printed, respectively, and to discharge the printed printing medium to the outside.

10. The image forming apparatus according to claim 2, further comprising a first medium feeding unit to feed the printing medium to the image forming unit at a normal feeding speed and an excessive feeding speed faster than the normal feeding speed in a printing medium feeding direction, wherein the controller controls the first medium feeding unit to feed the printed printing medium at the excessive feeding speed so that the printed printing medium is disposed in a position to be kicked by the kicker arm.

11. A kicking unit usable with an image forming apparatus, the kicking unit comprising:

a kicker to move a printing medium the kicker comprising:

a kicker driver to convert a movement of an image forming unit of the image forming apparatus into a rotation of the kicker on a kicker axis, the kicker driver comprising:

a cam spirally formed on a circumference of a main body of the kicker in the direction of the kicker axis, and a kicker driving member engaged with the cam to move with the image forming unit in the kicker driving section, and to rotate the kicker main body clockwise and counterclockwise, wherein the movement of the image forming unit is between a printing section for forming an image on the printing medium and a kicker driving section outside the printing section, wherein the movement of the image forming unit in the kicker driving section applies a driving force to the kicker.

12. The kicking unit of claim 11, wherein:

the kicker axis is substantially parallel with the movement of the image forming unit, and the kicker comprises a kicker arm to extend from the kicker main body in a radial direction and feed the printing medium in a printing medium feeding direction.

13. The kicking unit according to claim 11, wherein the kicker main body extends from the printing section to the kicker driving section, and the cam is formed on the circumference of the kicker main body within the kicker driving section.

14. The kicking unit according to claim 11, further comprising:

a guiding shaft formed to traverse the printing section and the kicker driving section and to be substantially parallel with the movement of the image forming unit, to guide the movement of the image forming unit, wherein the kicker driving member comprises a plate disposed adjacent to the guiding shaft to contact the image forming unit and to move within the kicker driving section.

15. The kicking unit according to claim 14, wherein:

the cam comprises a groove, and the plate comprises at least one of an insertion projection and a coupling projection to be inserted into the groove.

16. The kicking unit according to claim 14, wherein the kicker driver further comprises:

an elastic member to elastically bias the plate from the kicker driving section to the printing section.

17. The kicking unit according to claim 11, wherein the kicker driving member is exposed to the outside and contacts the image forming unit.

18. An image forming apparatus, comprising:

a kicker to kick a printing medium; and an image forming unit to form an image on the printing medium in a printing section and to apply a driving force to the kicker to move the kicker in a kicker driver section, wherein the kicker contacts the image forming unit such that the kicker moves together with the image forming unit in the kicker driving section, and the kicker comprises:

a kicker driver to convert the driving force of the image forming unit into a rotation of the kicker on a kicker axis, the kicker driver comprising:

a cam spirally formed on a circumference of a main body of the kicker in the direction of the kicker axis, and a kicker driving member engaged with the cam to move with the image forming unit in the kicker driving section, and to rotate the kicker main body clockwise and counterclockwise.

19. A method of moving a printing medium through an image forming apparatus having a kicking arm, the method comprising:

providing a kicker to kick a printing medium following printing; and controlling an image forming unit to form an image on the printing medium in a printing section and to apply a driving force to the kicker to move the kicker in a kicker driver section, wherein the kicker contacts the image forming unit such that the kicker moves together with the image forming unit in the kicker driving section, and the kicker comprises:

a kicker driver to convert the driving force of the image forming unit into a rotation of the kicker on a kicker axis, the kicker driver comprising:

a cam spirally formed on a circumference of a main body of the kicker in the direction of the kicker axis, and a kicker driving member engaged with the cam to move with the image forming unit in the kicker driving section, and to rotate the kicker main body clockwise and counterclockwise.

* * * * *